United States Patent [19]

Kusz

[11] 4,346,809

[45] Aug. 31, 1982

[54] TWO-PIECE CLOSURE HAVING A CHILD-RESISTANT MODE AND A NON CHILD-RESISTANT MODE

[75] Inventor: Maximillian Kusz, Waterville, Ohio

[73] Assignee: Owens-Illinois, Inc., Toledo, Ohio

[21] Appl. No.: 259,134

[22] Filed: Apr. 30, 1981

[51] Int. Cl.[3] ..... B65D 55/02

[52] U.S. Cl. ..... 215/214; 215/222

[58] Field of Search ..... 215/206, 214, 222, 223

[56] References Cited

U.S. PATENT DOCUMENTS

| | | | |
|---|---|---|---|
| 3,865,267 | 2/1975 | Morris | 215/214 X |
| 4,059,198 | 11/1977 | Mumford | 215/222 |
| 4,156,489 | 5/1979 | Kong | 215/222 X |

*Primary Examiner*—George T. Hall

*Attorney, Agent, or Firm*—John R. Nelson; Myron E. Click; David H. Wilson

[57] ABSTRACT

A convertible child-resistant closure comprises an outer closure and an inner resilient liner. When applied to a cooperating container in the child-resistant mode, the resilient liner is distorted between the container rim and abutments formed on the outer closure panel, thereby providing an upward locking bias to the closure. The upper surface of the liner includes depressions adapted to receive the abutments only when the liner and the outer closure are in a particular relative angular orientation. To convert the assembly to a closure which is not child-resistant, the liner is removed and reoriented so that the abutments are received within the depressions, thereby preventing the abutments from distorting the liner to provide the locking bias.

7 Claims, 4 Drawing Figures

TWO-PIECE CLOSURE HAVING A CHILD-RESISTANT MODE AND A NON CHILD-RESISTANT MODE

BACKGROUND OF THE INVENTION

1. Field of the Invention

The invention relates to a child-resistant closure which can be converted to a closure which is not child-resistant.

2. Description of the Prior Art

Packaging for many substances, in particular prescription medicines, is required by governmental regulations to be child-resistant. The typical child-resistant closure requires a particular sequence of manipulations, or simultaneous manipulations to effect removal of the closure. The prior art is replete with many examples of child-resistant closures which have been effective in preventing access to harmful substances by children, while generally being removable by adults.

There are adult users who sometimes encounter difficulty in opening child-resistant closures. Some elderly consumers, or consumers afflicted with arthritis, may be unable to open child-resistant closures. While such users may request a pharmacist to supply medicines with a closure which is not child-resistant, this choice leaves the user without the option to later reseal the container in a child-resistant mode, should this be necessary. It is also possible for a consumer to be supplied with two closures, one child-resistant, and the other one not child-resistant. A single closure which can be utilized in either a child-resistant or non child-resistant mode is an alternative providing further convenience to the user.

Although convenience to adult users is highly important, another important criterion is that the conversion to a closure which is not child-resistant requires some special manipulation, thereby to discourage casual use of the closure in the non child-resistant mode.

A dual purpose closure is described in U.S. Pat. No. 3,865,287 and Re. 29,779 to Morris. Morris discloses a unitary reversible closure, having two independent positions of use for sealing a container, one of which is child-resistant, and the other of which is not child-resistant. No manipulation of the closure, other than its inversion, is necessary to reseal a container such that it is not child-resistant. Hence, there is the potential that some users would reapply the closure in this configuration, without pausing to consider whether the child-resistant configuration should be utilized instead.

SUMMARY OF THE INVENTION

It is accordingly an object of the present invention to provide a closure which can be conveniently converted from a child-resistant mode to a non child-resistant mode, the conversion requiring a particular deliberate manipulation. The invention provides an improvement in a two-piece, "push down and turn" type of child-resistant closure, as exemplified in U.S. Pat. No. 4,059,198 to Mumford. A two-piece closure embodying the invention comprises an outer closure and an inner, flexible, resilient liner. The closure and an associated container are provided with cooperating locking lugs. In the child-resistant mode, the resilient liner is disposed between the closure and the container rim in such a manner as to exert a biasing force to maintain the lugs in locked engagement. The liner can be removed, reoriented, and reinserted so that it will not exert such a biasing force, and the closure will not be child-resistant.

The closure comprises a circular top panel, and an annular skirt depending from the periphery thereof. A plurality of circumferentially spaced, inwardly projecting keys are integrally formed on the inside surface of the skirt, adjacent the lower annular edge of the skirt.

When the closure is applied, the skirt is disposed around an associated container rim, and the inwardly projecting keys lie adjacent the outside cylindrical surface of the container neck. The container neck includes lugs which project outwardly from its outside cylindrical surface, having downwardly opening notches constructed and arranged to receive the keys of the closure skirt. When the keys are disposed within the notches, the closure cannot be lifted axially straight off of the container, but must first be pushed downwardly and rotated to disengage the keys and notches.

The resilient disc shaped liner is disposed within the closure, and retained therein by the inwardly projecting keys. The liner includes a downwardly projecting annular plug member, constructed and arranged to sealingly engage the inside cylindrical surface of the container neck.

A plurality of abutments depend from the inside surface of the panel, and provide two levels of spacing of the liner from the inside panel surface. The liner includes upwardly opening depressions arranged to receive the abutments only when the liner and the outer closure are in a particular angular orientation. When the closure is in the child-resistant configuration, the abutments do not fit within the depressions, and hence maintain a relatively large spacing between the liner and the panel. When the closure is applied and locked, the liner is resiliently deformed between the rim of the container and the abutments. The liner therefore exerts an upwardly directed biasing force on the closure relative to the container, thereby maintaining the locking engagement of the keys and notches.

When a closure is desired which is not child-resistant, the liner is removed and reinserted so that the abutments fit within the depressions formed in the liner. When the closure is applied, the abutments or the panel force the plug member of the liner into sealing engagement with the container rim, but the abutments do not extend downwardly sufficiently to deform the liner between the closure and the container rim. The liner therefore exerts no locking bias.

DESCRIPTION OF THE PREFERRED EMBODIMENT

Figure 1:
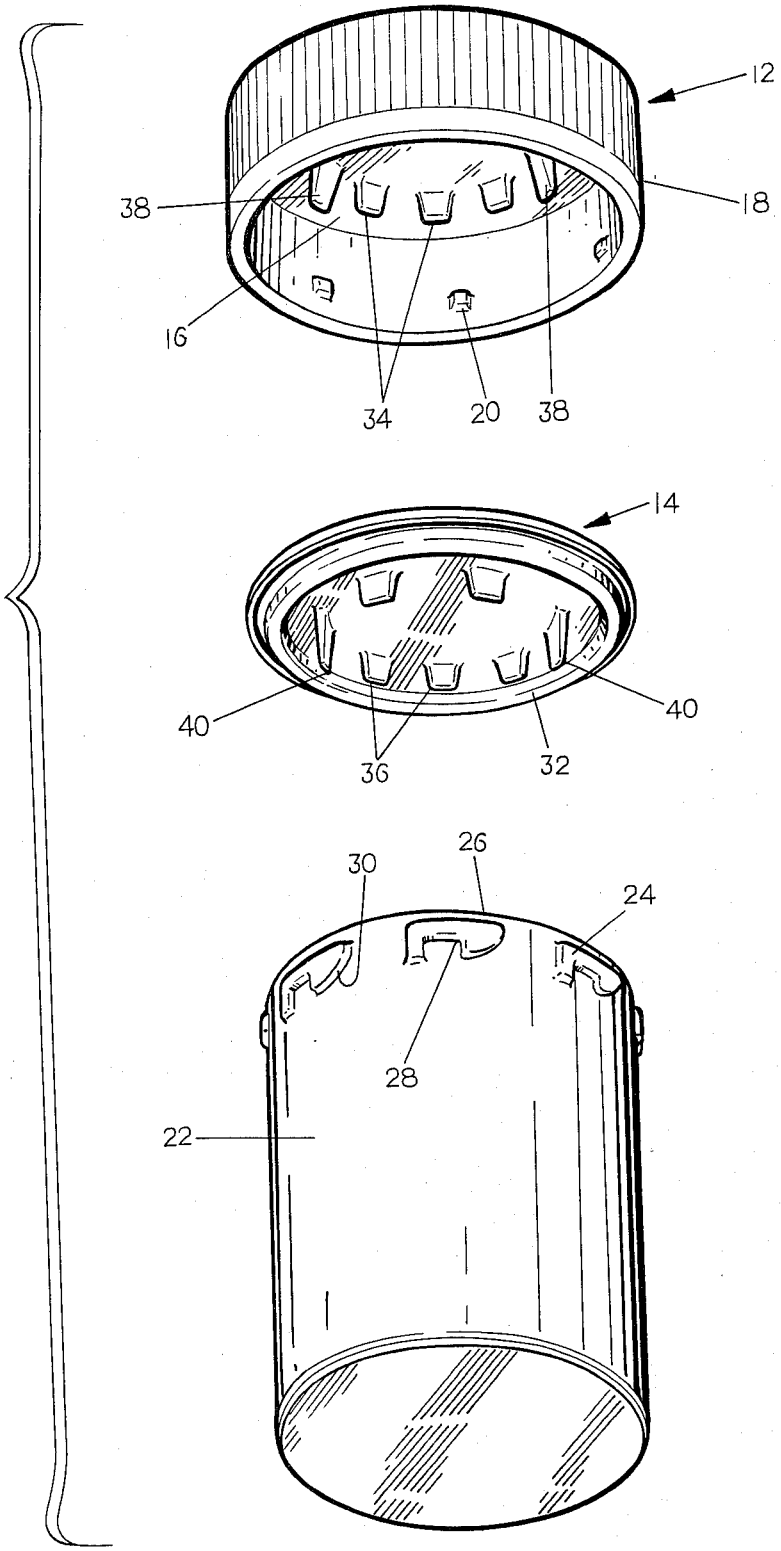
FIG. 1 is an exploded, perspective view of a child-resistant, two-piece closure embodying the present invention, with an associated vial.

As illustrated in the drawings, a child-resistant closure 10 embodying the invention comprises an outer closure 12 and an inner plug liner 14. The outer closure 12 comprises a top circular panel 16, and an annular skirt 18 depending from the periphery thereof. A plurality of integrally formed, circumferentially spaced, locking keys 20 project radially inwardly from the inside annular surface of the skirt 18. The inside diameter of the skirt 18 is somewhat greater than the outside diameter of an associated vial 22, and the inside diameter defined by the innermost surfaces of the keys 20 is only slightly greater than the outside diameter of the vial 22.

The vial 22 includes a plurality of circumferentially spaced locking lugs 24 which project outwardly from the outside cylindrical surface of the vial, near the rim 26 of the vial. The circumferential spacing of the lugs 24 corresponds to the circumferential spacing of the locking keys 20 of the closure 12. Each lug 24 includes a downwardly opening notch 28, and tapering camming surfaces 30 for guiding the keys 20 into the notches 28.

The closure 10 is applied by orienting the keys 20 of the outer closure 12 between the lugs 24 of the vial. The outer closure 12 is then rotated, causing the locking keys 20 to slide along the camming surfaces 30 until they are received within the notches 28. To remove the closure 10, it is first necessary to press the outer closure 12 downwardly relative to the vial 22, to disengage the locking keys 20 from the notches 28. The closure 10 can then be removed from the vial 22 by rotating it sufficiently to allow the locking keys 20 to pass between the locking lugs 24 as the closure 10 is lifted from the vial 22.

The liner 14 provides a selectively operable means for biasing the outer closure 12 upwardly relative to the vial 22, to maintain the locking engagement of the keys 20 in the notches 28. The liner 14 is generally disc shaped, having a diameter slightly greater than the inside diameter defined by the innermost surfaces of the locking keys 20, whereby the liner 14 is retained within the outer closure 12. The liner 14 includes an integrally formed downwardly projecting plug 32 constructed and arranged to sealingly engage the inside cylindrical surface of the vial 22. The liner 14 is preferably formed from a resilient, nonpermeable material, such as low density polyethylene. When pressed into sealing engagement with the rim 26 of the vial 22, the liner 14 therefore provides a vapor seal, for preventing moisture from penetrating into the vial 22 and deteriorating contents of the vial 22, such as medicines.

The outer closure 12 includes a plurality of integrally formed, spaced abutments 34 which project downwardly from the inside surface of the panel 16. The liner 14 includes upwardly opening depressions 36 arranged to receive the abutments only when the liner 14 and the outer closure 12 are in a particular angular orientation. When the liner 14 and the outer closure 12 are not in this orientation, the abutments 34 contact the upper surface of the liner 14 to provide a determinant spacing between the panel 16 and the liner 14. In this configuration, illustrated in FIG. 3, the closure 10 is in a child-resistant mode. When the closure 10 is applied to the vial 22 in this configuration, the liner 14 is resiliently deformed between the rim 26 of the vial 22 and the abutments 34. The deformed resilient liner 16 therefore exerts an upward bias on the outer closure 12 relative to the vial 22, to retain the locking keys 20 in engagement with the downwardly opening notches 28. To disengage the keys 20 and the notches 28, it is first necessary to push downwardly on the outer closure 12, deforming the resilient liner 14 further. While the outer closure 12 is manually held in this axial position relative to the vial 22, the outer closure 12 is rotated, removing the keys 20 from the notches 28.

In the preferred embodiment, the outer closure 12 also includes two indexing projections 38 which downwardly depend from the inside surface of the panel 16 a greater distance than the abutments 34 (FIG. 1). The liner 14 is provided with corresponding deep sockets 40 arranged to receive the indexing projections 38. The indexing projections 38 are symmetrically spaced on a diameter of the panel 16. The indexing projections 38 project downwardly a greater distance than the axial distance between the inside surface of the panel 16 and the top of the liner 14 when the liner 14 is in contact with the locking keys 20. Hence the liner 14 will fit within the outer closure 12 only when the indexing projections 38 are disposed within the sockets 40 in the liner 14. As the projections 38 and sockets 40 are symmetrically located on respective diameters of the panel 16 and the liner 14, the liner 14 can be assembled into the outer closure 12 in only two orientations, 180° apart.

Figure 4:
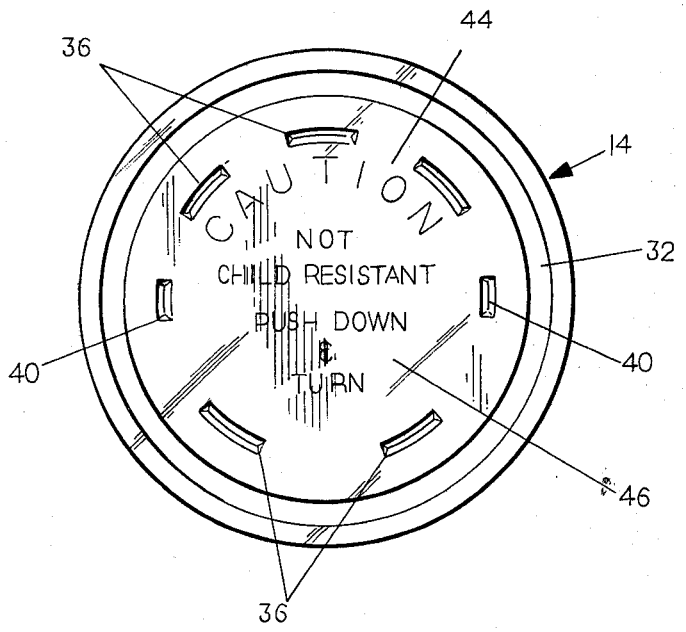
FIG. 4 is a top plan view of the inner liner.

An effective arrangement of depressions 36 is illustrated by the top plan view of the liner 14 shown in FIG. 4. The depressions 36 are disposed in a circular array within the circumference of the plug 32. The two large sockets 40 for receiving the indexing projections 38 are diametrically opposite each other. Three depressions 36 are located on one side of the sockets 40; cooperating abutments 34 are correspondingly spaced on the panel 16 of the outer closure 12. On the other side of the sockets 40, only two depressions 36 are formed, their cooperating abutments 34 also being correspondingly spaced. The angular spacing of the pair of abutments 34 on one side of the indexing projections 38 does not correspond to the spacing of the three abutments 34 on the opposite side. Thus in one orientation of the liner 14, all of the abutments 34 are aligned with corresponding depressions 36. When the liner 14 is removed from the outer closure 12, rotated 180°, and reinserted, none of the abutments 34 are aligned with a cooperating depression 36.

Figure 3:
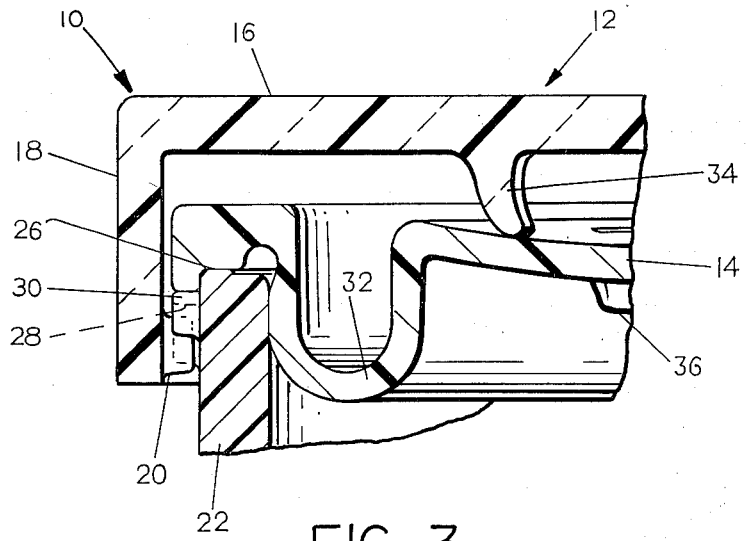
FIG. 3 is an enlarged scale, partial sectional view showing the relationship of the outer closure and the inner liner in the child-resistant mode.
Figure 2:
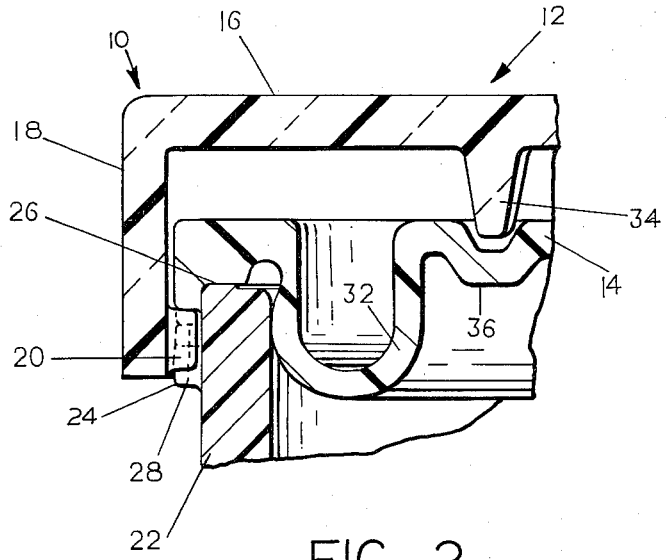
FIG. 2 is an enlarged scale, partial sectional view, showing the closure in sealing relationship to a vial, not in a child-resistant mode.

The child-resistant closure 10 would normally be supplied in a child-resistant mode, with the abutments 34 not aligned with the depressions 36. In this configuration, as illustrated in FIG. 3, the liner 14 is resiliently deformed between the abutments 34 and the vial rim 26 when the closure is in locking engagement with the vial 22. If the customer wishes to reseal the container so that it will not be child-resistant, he must remove the entire closure 10, then remove the liner 14 from the outer closure 12. The liner 14 could be pulled out of the outer closure 12 by means of one of the sockets 40, or the liner 14 could be pried out with a fingernail or small blade. The liner 14 would then be reinserted in the outer closure 12 in a position rotated 180° from its original position. As illustrated in FIG. 2, the plug 32 of the liner 14 can then be pressed into engagement with the vial rim 26 by the outer closure 12 without being deformed. Consequently, the liner 14 exerts no locking bias on the outer closure 12. In this configuration, the outer closure 12 is loosely disposed around the vial rim 26, and the locking keys 20 cannot be locked into the notches 28. The outer closure 12 can be lifted straight off the vial 22, the keys 20 pulling the liner 14 from engagement with the rim 26 of the vial 22.

Although the conversion of the closure 10 from a child-resistant to a non child-resistant mode is simple for an adult, it requires a definite deliberate procedure. Thoughtless use of the closure 10 in a non child-resistant mode is therefore prevented. The desire of a careful adult user for convenient use of the closure is therefore compatible with the needs of small children for protection.

Preferably, one semi-circular half of the panel 16 is made as nearly transparent as possible with regard to the material used. The half of the liner 14 visible through the panel when the closure 12 is in a non child-resistant mode contains appropriate embossed or imprinted indicia 44 warning that the closure is not child-resistant. The other half of the liner 14 is preferably provided with indicia 46 instructing in the use of the child-resistant closure 10. The outer closure 12 is preferably molded from a thermoplastic resin such as polypropylene. Roughened mold surfaces can be used to define opaque portions of the molded closure; smooth mold surfaces to define transparent portions.

Although a particular arrangement of spacing abutments and depressions, and indexing projections and sockets have been illustrated and described, obviously other configurations may be used to achieve the same results. Any contoured configuration of the liner 14 and the outer closure 12 comprising spacing means capable of providing a selectively differential spacing between these two members could be employed. It is contemplated that other aspects of the invention as described could be altered without departing from the spirit of the invention. The scope of the invention is therefore to be limited only by the appended claims.

What is claimed is:

1. A convertible child-resistant closure for an open mouth container having an annular rim on the open end thereof, and circumferentially spaced locking lugs having downwardly opening notches, comprising an outer closure, said outer closure including a circular panel section and an annular skirt depending from the periphery thereof, said skirt sized to fit around the annular rim of the container, a plurality of integrally formed, circumferentially spaced keys projecting inwardly from the inside annular surface of said skirt and constructed and arranged to fit within the notches of said locking lugs; a resilient, disc shaped liner within said outer closure; means on said outer closure to retain said liner within said outer closure, permitting limited axial movement of said liner within said closure, selectively engagable spacing means on said panel and said liner providing two relative axial positions of said liner within said outer closure, said spacing means arranged to deform said resilient liner between said rim and said spacing means when said liner is in one axial position relative to said outer closure, thereby providing an upward bias to retain said keys within said notches.

2. The closure defined in claim 1 wherein said inner liner includes an annular plug adapted to sealingly engage the inside annular surface of said container rim.

3. The closure defined in claim 1 wherein said spacing means comprises abutments depending from the inside surface of said panel and corresponding depressions formed in the upper surface of said liner, arranged such that said depressions will receive said abutments when said liner and said outer closure are in a first relative angular orientation, and will not receive said abutments when said liner and said outer closure are in a second angular orientation.

4. The closure defined in claim 3 including indexing means on said closure and said liner for restricting the orientation of said liner within said outer closure to either of said angular orientations.

5. The closure defined in claim 4 wherein said indexing means includes indexing projections longer than said abutments, depending from the inside surface of said panel, and cooperating sockets formed in the upper surface of said liner to receive said indexing projections.

6. The closure defined in claim 5 including two indexing projections symmetrically arranged on a diameter of said closure panel, whereby said liner is insertable within said outer closure in either of only two angular orientations, 180° apart.

7. The closure defined in claim 3 wherein at least a portion of the panel of said outer closure is transparent, and the upper surface of said liner is provided with indicia visible through said transparent portion, whereby the orientation of the liner within the outer closure can be ascertained.

* * * * *